United States Patent [19]

Yoneda et al.

[11] 4,367,811

[45] Jan. 11, 1983

[54] ELEVATOR CONTROL SYSTEM

[75] Inventors: Kenji Yoneda; Kazuhiro Sakata; Takeo Yuminaka; Masao Nakazato; Tomiaki Kurihara; Soshiro Kuzunuki, all of Katsuta; Yasunori Katayama, Hitachi, all of Japan

[73] Assignee: Hitachi, Ltd., Tokyo, Japan

[21] Appl. No.: 236,608

[22] Filed: Feb. 20, 1981

[30] Foreign Application Priority Data

Feb. 22, 1980 [JP] Japan ..... 55-20442

[51] Int. Cl.[3] ..... B66B 1/18

[52] U.S. Cl. ..... 187/29 R

[58] Field of Search ..... 187/29

[56] References Cited

U.S. PATENT DOCUMENTS

| | | | |
|---|---|---|---|
| 3,425,515 | 2/1969 | McDonald et al. | 187/29 |
| 3,589,474 | 6/1971 | Waure | 187/29 |
| 3,592,296 | 7/1971 | Senn | 187/29 |
| 3,750,850 | 8/1973 | Winkler et al. | 187/29 |
| 3,773,146 | 11/1973 | Dixon, Jr. et al. | 187/29 |
| 4,134,476 | 1/1979 | Zolnerovich, Jr. et al. | 187/29 |
| 4,246,983 | 1/1981 | Bril | 187/29 |

*Primary Examiner*—J. V. Truhe
*Assistant Examiner*—W. E. Duncanson, Jr.
*Attorney, Agent, or Firm*—Antonelli, Terry and Wands

[57] ABSTRACT

In an elevator control system, in which the elevator car is controlled on the basis of elevator car positions obtained through the counting of distance pulses provided in proportion to the distance travelled by the car and floor height data indicative of the heights of individual floors, the distance pulses are counted by moving the car at a low speed from the lowest floor to the highest floor, and the count at the time of the actuation of a floor position detector, which is actuated when the car passes by each floor, is stored as the floor height value of that floor in a RAM (Random Access Memory). With this arrangement, the measurement of the floor heights is facilitated, and also the preparation of a ROM (Read-Only Memory) for storing the floor height data for each elevator car is made needless to promote the standardization.

9 Claims, 15 Drawing Figures

FIG. 5

| ADDRESS | DATA | ADDRESS | DATA |
|---|---|---|---|
| $A_1$ | TIMER FLAG | $F_0$ | REFERENCE POSITION (0m) |
| $A_2$ | CONCENT OF PTM-C | $F_1$ | 1-ST FLOOR HEIGHT (10m) |
| $A_3$ | CAR POSITION | $F_2$ | 2-ND FLOOR HEIGHT (15.1m) |
| $A_4$ | DIRECTION OF CAR TRAVEL | $F_3$ | 3-RD FLOOR HEIGHT (19.2m) |
| $A_5$ | NEAREST FLOOR | $F_4$ | 4-TH FLOOR HEIGHT (26.8m) |
| $A_6$ | NEXT POSSIBLE-TO-STOP FLOOR | ⋮ | ⋮ |
| $A_7$ | NEXT STOP FLOOR | $F_n$ | N-TH FLOOR HEIGHT (30.0m) |
| ⋮ | ⋮ | $F_{n+1}$ | SUM CODE (10.1m) |
| $A_{21}$ | FLOOR HEIGHT MEASUREMENT RUN STAGE SIGNAL | | |
| $A_{22}$ | FLOOR HEIGHT MEASUREMENT FLOOR | | |
| $A_{23}$ | FLOOR HEIGHT MEASUREMENT RUN REQUEST SIGNAL | | |
| $A_{24}$ | SUM CHECK ADDRESS | | |

ELEVATOR CONTROL SYSTEM

This invention relates to elevator systems, and more particularly to the method of and system for elevator system control, which is suited to where the control is digitally effected by using distance pulses provided as the elevator car is being moved.

Recently, elevator control systems where elevator cars are digitally controlled with computors through electrically detecting the car position have been developed and adopted in practice in place of systems where the car position is mechanically detected.

For example, the U.S. Pat. No. 3,589,474 discloses a speed control system, which is provided with a pulse generator for producing pulses corresponding to the distance travelled by the car (i.e., distance pulses), and the distance pulses are counted for calculating the destination data required for detecting the floor at which the car is to be stopped and related deceleration pattern as well as the present car position. Also, the U.S. Pat. No. 3,750,850 teaches to control the elevator on the basis of the count of distance pulses mentioned above.

However, the car position and other data obtained through the counting of such distance pulses merely indicate relative positions with respect to a particular point in a hatchway. Therefore, these count data alone have no bearing upon each landing position and are not useful as data on the basis of which to control the car. In order to be able to obtain the car control, it is necessary to previously measure the distance of each landing position (i.e., floor height) from the afore-mentioned reference point. Through the comparison of the measured floor height value and the afore-mentioned count it is possible to have the knowledge of the floor at which the car is positioned and obtain car stop control at each landing position.

Accordingly, the system where the elevator car is controlled on the basis of the count of distance pulses is provided with a memory for storing the measured floor height data, and the precision of the floor height value is very important. For example, in the deceleration control the elevator car is controlled such that the stored floor height data and the count coincide. Therefore, if an error is contained in the floor height data, it directly appears as a landing error. Attempts of forcibly correcting such a landing error, however, spoil the comfort of the passengers.

The floor height data usually contain more or less errors with respect to those at the time when the building structure is designed, so that the floor height values indicated in the design drawings cannot be directly used.

For this reason, it has been in practice to directly measure the height of each floor of the building on the site with a scale or the like before the installation of the elevator. Alternatively, according to the U.S. Pat. No. 3,750,850, the car is accurately positioned at each floor by manual operation, and then it is moved toward the next floor and stopped again at the exact landing level. The distance travelled at this time is determined from the count of pulses generated while the car is in motion.

The floor height of the building that is measured in the above way is accurate and never variable.

It has therefore been in practice to permanently fix the floor height data, obtained by measurements, in a ROM (Read-Only Memory) so that they would not be lost due to noise or power loss and then assemble the ROM in the control system.

Meanwhile, the measured floor height data vary with building structures, so that the measurement word as described above is necessary for each new building. This is a drawback in view of the standardization of the control system and betterment of the manufacture control.

The primary object of the invention is to provide a method of elevator control, in which the elevator is controlled on the basis of the elevator car position obtained from the count of distance pulses provided in accordance with the distance travelled by the car and the floor height data indicative of the distance up to each floor, and which permits the measurement of the floor height speedily and easily.

A second object of the invention is to improve the manufacture control of the elevator control system which makes use of the afore-mentioned floor height data.

The present invention will be apparent from the following detailed description taken in conjunction with the accompanying drawings, in which:

FIGS. 1 through 12 illustrate one embodiment of the invention, and in which:

FIG. 1 is a schematic diagram, partly in block form, showing an elevator system as a whole;

FIG. 2 is a block diagram showing a microcomputer 14;

FIG. 3 is a block diagram showing a programmable timer counter (PTM);

FIG. 4 is a flow diagram illustrating the main program of the microcomputer 14;

FIG. 5 is a view showing the memory map of a RAM 27;

FIG. 6 is a flow diagram illustrating the program of a car position calculation step 140;

Figure 8:
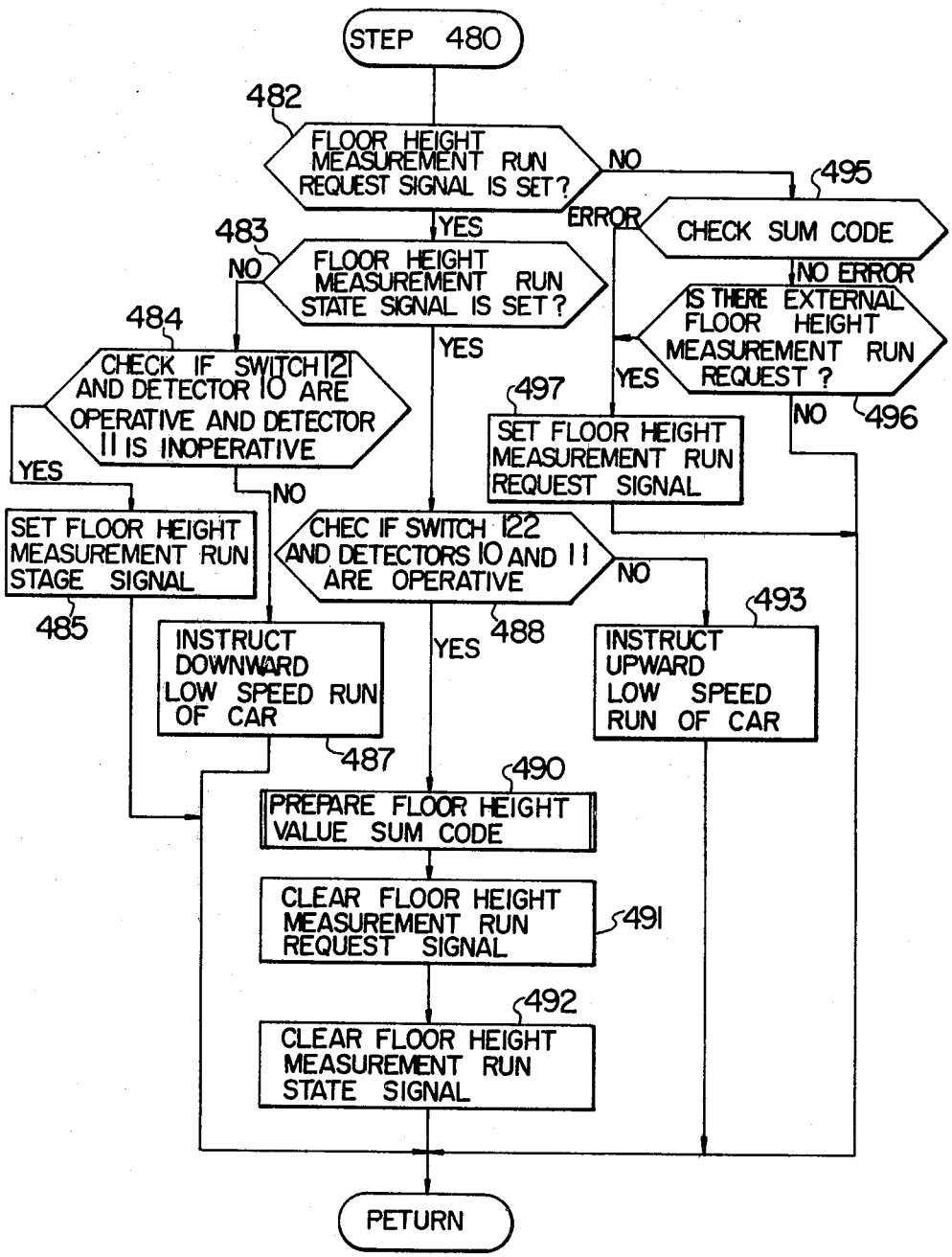
Figure 9:
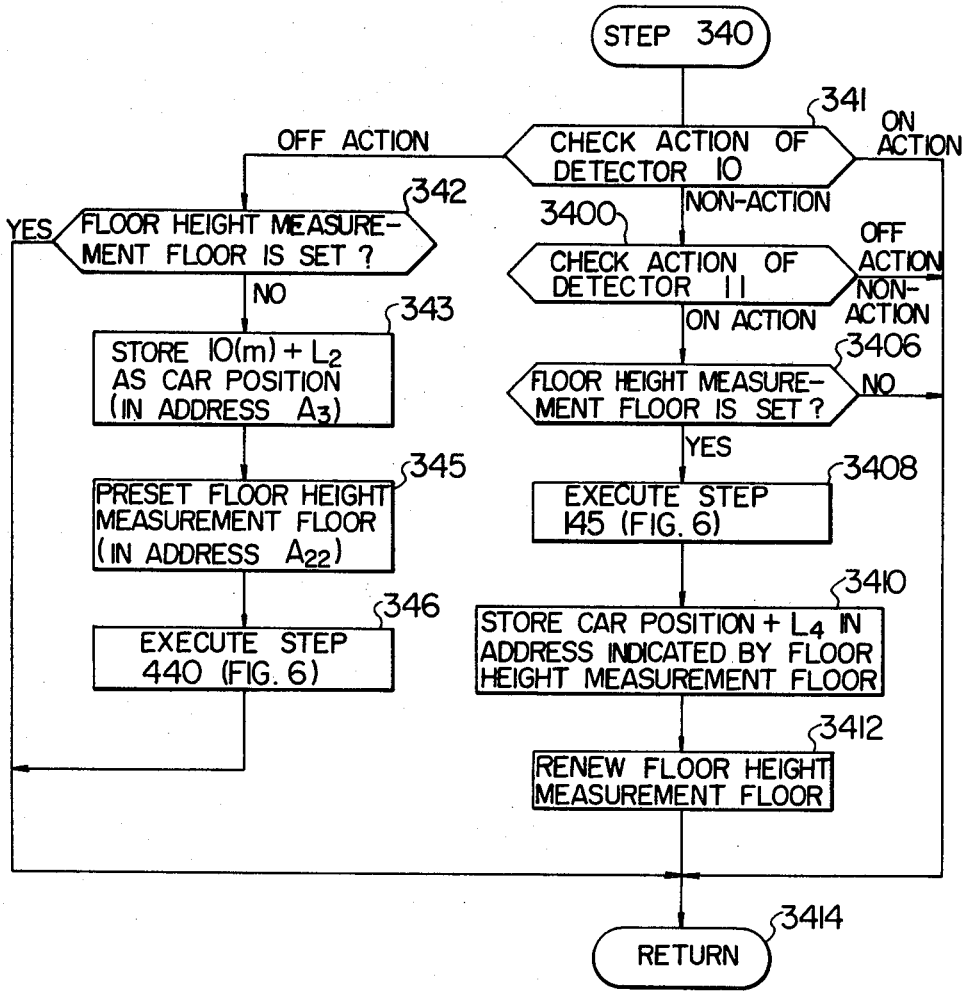
Figure 10:
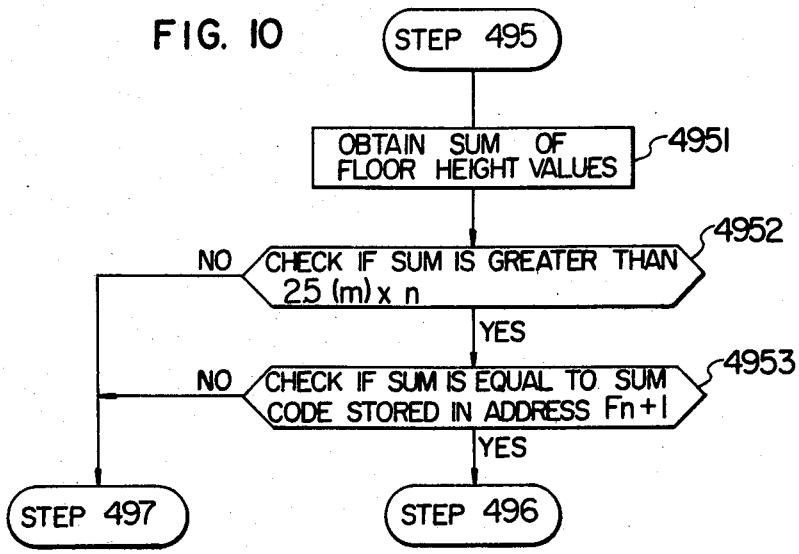
Figure 12:
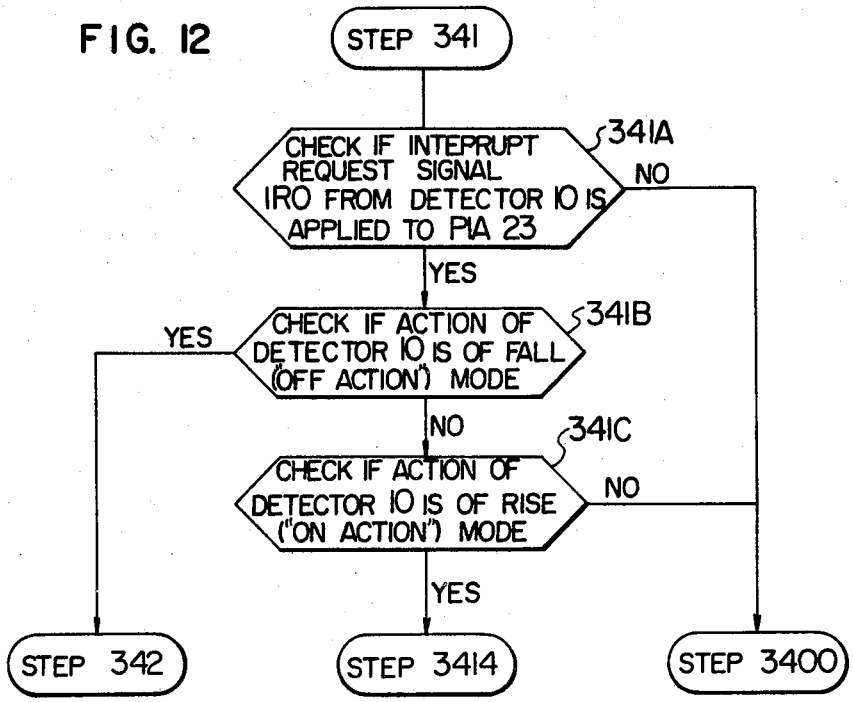
Figure 11:
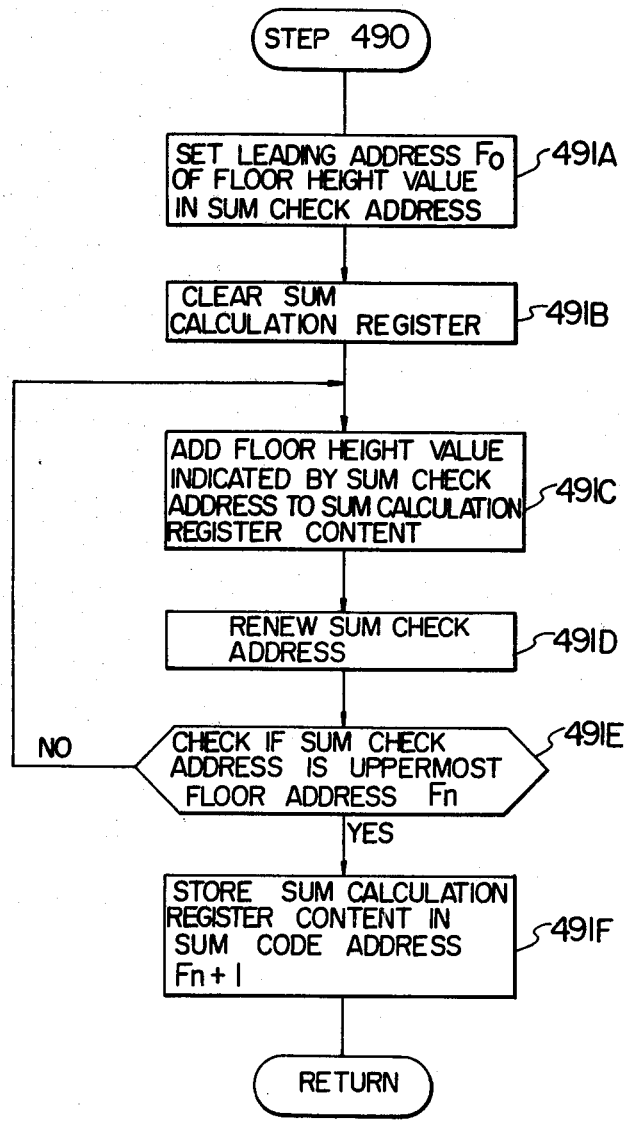

FIGS. *7a* to *7d* are views illustrating the operational principles underlying floor height measurement run;

FIG. 8 is a flow diagram illustrating a floor height measurement run processing step;

FIG. 9 is a flow diagram illustrating the program of a floor height measurement step 340;

FIG. 10 is a flow diagram illustrating the program of a sum code check step 495;

FIG. 11 is a flow diagram illustrating the program of a sum code preparation step 490; and FIG. 12 is a flow diagram illustrating the program of a position detector operation determination step 340.

Now, an embodiment of the invention will be described in detail with reference to the accompanying drawings.

Figure 1:
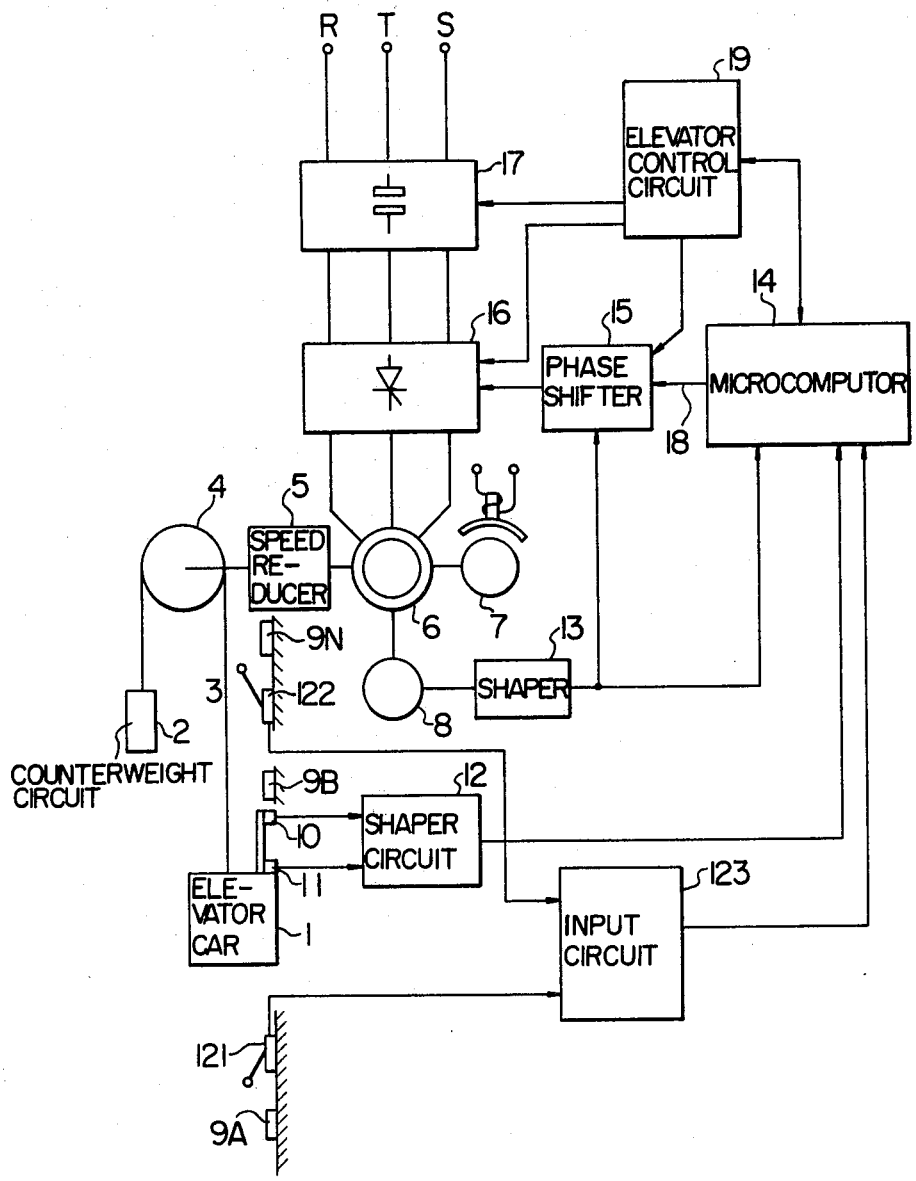

FIG. 1 represents an elevator system as a whole. Referring to the Figure, an elevator car 1 is supported by a rope 3 reeved over a traction sheave 4, and a counterweight 2 is connected to the other end of the rope 3. The traction sheave 4 is coupled to a speed reducer 5, which is in turn coupled to an elevator drive three-phase induction motor 6 and an electromagnetic brake 7. Also coupled to the induction motor 6 is a pulse generator 8 which generates distance pulses in proportion to the distance travelled by the car 1. In this embodiment, an alternating current tachometer generator is used as the pulse generator 8.

Figure 2:
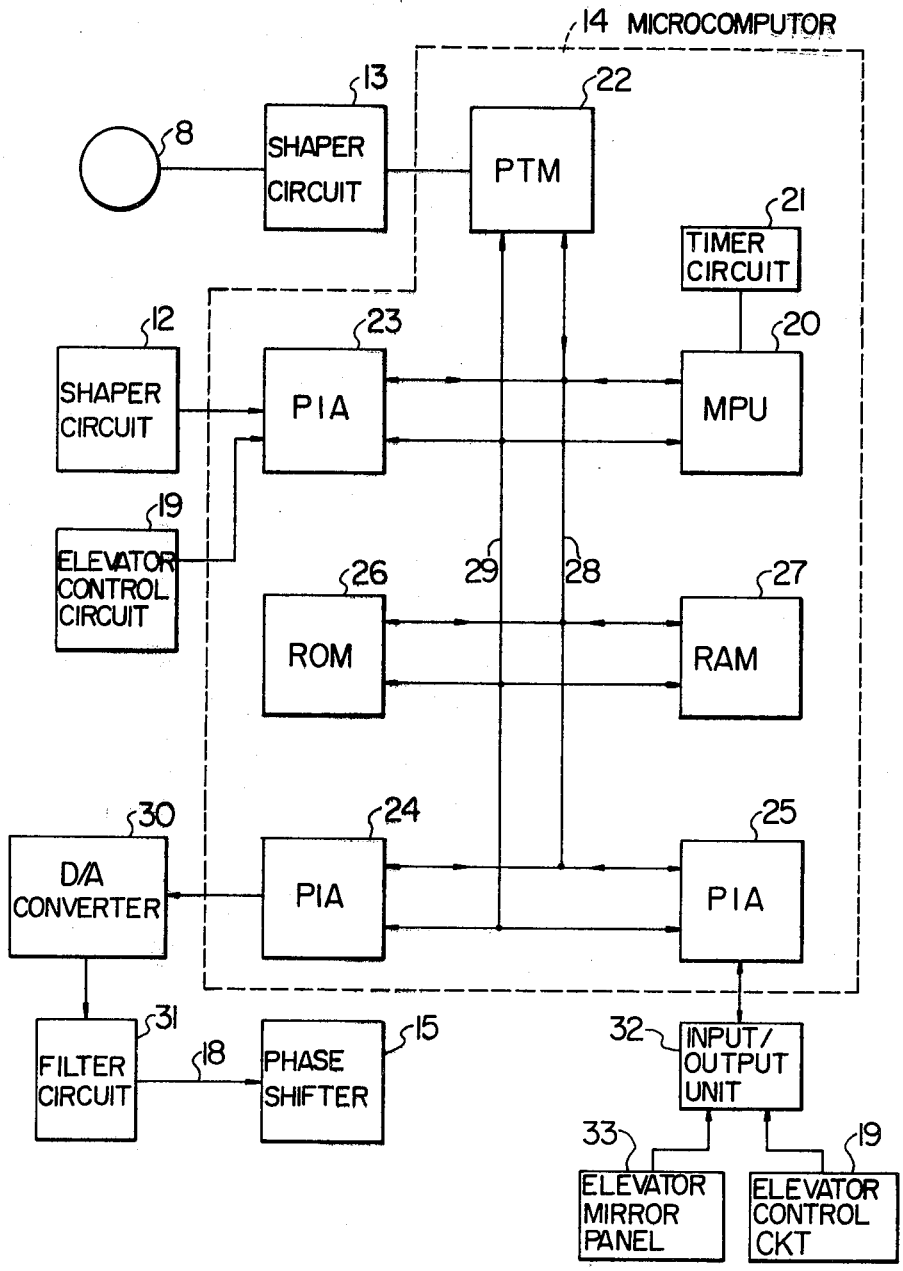

Labeled R, T and S are respective phase line terminals of a three-phase alternating current power source. These terminals are connected through a main switch circuit 17 to a thyristor controlled unit 16. The main switch circuit 17 has switches which are appropriately combined for up and down operations, maintenance operation, normal operation, etc. of the elevator system. The thyristor controlled unit 16 includes thyristors and/or switches and is controlled by a phase shifter 15. The signal produced from the tachometer generator 8 is used for feedback control, and it is fed through an elevator control digital computor, for instance a microcomputor 14 as shown in FIG. 2, to the phase shifter 15. Through this speed control, the car 1 is moved at speeds analogous to the contents of speed instructions 18 generated from the microcomputor 14.

The microcomputer 14 generates the speed instruction 18 as it receives a floor position signal from a shaper circuit 12, signals from the tachometer generator 8 and an elevator control circuit 19 and an internal clock. While the microcomputor 14 is a weak electricity circuit, the control circuit 19 is a strong electricity circuit and drives the main switch circuit 17 and other elements.

The floor position signal mentioned above is obtained from the shaper circuit 12 as signals provided from floor position detectors 10 and 11 mounted on the car pass by shield plates 9A, 9B, . . . , 9N provided in a hatchway of the building for the individual floors are fed to the shaper.

Signals from extremety floor deceleration switches 121 and 122 are coupled through an input circuit 123 to the microcomputor 14. The shaper circuit 13 provides a pulse signal according to the alternating current output of the tachometer generator 8, that is, it provides a pulse every time a constant distance is travelled by the car 1. Knowledge of the distance covered by the elevator car can thus be obtained by counting the distance pulses provided. The distance pulse output is coupled to the microcomputor 14.

The microcomputor 14 is shown enclosed by a dashed loop in FIG. 2. It includes a microprocessor unit (abbreviated MPU) 20, a timer circuit 21 for determining the operation timing of the MPU 20 and informing the MPU 20 of the lapse of a particular period of time, a programmable timer counter (abbreviated PTM) 22 for counting input pulses to it, peripheral interfaces (PIA) 23, 24 and 25 for supplying and taking out digital signals to and from the outside of it, a ROM (Read-Only Memory) 26 in which programs of operation of the MPU 20 are stored, a RAM (Random Access Memory) 27 which is used as a working area of the MPU 20 for temporarily storing data, data buses 28 for the transfer of data among the individual elements, and control buses 29 used for the selection of memory addresses and elements and also for the transfer of clock signals, interrupt signals, etc. The position signal from the shaper circuit 12 is fed to the PIA 23 which is set such as to receive digital signals. The speed instruction 18 is coupled from the microcomputor 14 through a digital-/analog (D/A) converter 30 which converts the digital signal output of the PIA 24 into an analog signal and also through a filter circuit 31. The outputs from an elevator monitor panel 33 and the elevator control circuit 19 (FIG. 1) are fed through an input/output unit 32 to the PIA 25.

The individual component elements of the microcomputor 14 mentioned above are all of well-known constructions, for example, the MPU 20, PTM 22 and PIAs 23, 24 and 25 may be constructed with "MC6800", "MC6840" and "MC6821" by MOTOROLA Semiconductors Ltd., and the RAM 27 and ROM 26 with "I2114" and "I2716" by INTEL company.

The construction and operation of the PTM 22 has direct bearing upon the floor height measurement according to the invention, so the description thereof will now be given with reference to the block diagram of FIG. 3.

As is shown in the Figure, the PTM 22 is connected through the data bus 28 and control bus 29 which includes clock and address buses, these buses being within the microcomputor 14, and also connected through the shaper circuit 13 to the tachometer generator 8.

The MPU 20 can permit the loading of data on the data bus through a buffer 53 into a control register 50 and a latch 52. The contents of a counter 51 and a flag register 61 are read out through the buffer 53 into the MPU 20.

The PTM 22 can be used in various ways depending upon the data that is loaded into the control register. Here, the functions that are required for the generation of the car speed instruction and the detection of the car position will be discussed.

As a first use, the generation of a speed instruction at the time of initiating acceleration will be described. In this use, when a reset signal on the control bus 29 is accepted by the control register 50 or when a particular bit of the control register becomes zero, the operation is started, that is, the data latched in the latch 52 is stored in the counter 51, the internal clock signal on the control bus 29 is output to the signal line 62, and the clock selection switch is switched to the side of the signal line 62, so that the count of the counter 51 is decremented every time the falling of the internal clock is detected. Also, as soon as the count of the counter 51 is decremented by one from zero, a flag indicative of the fact that the counting is ended is set in the flag register 61. Further, when an interrupt flag is set in the flag register 61, the content in the latch 52 is loaded with the counter 51 so that it is decremented again by the internal clock.

The writing of data in the latch 52 may be done at any time.

By storing the instruction codes that dictates the above operation in the control register 50 of the PTM 22, an acceleration instruction for increasing speed with the lapse of time from the start of the car can be generated.

As a second use, a method of generating a speed instruction at the time of deceleration will be given. In this case, the select switch 60 is set such as to direct the distance pulses from the alternating current tachometer generator 8 to the counter 51. A code which dictates this operation while the other operation is the same as in the first use is stored in the control register 50. By so doing, the PTM 22 can calculate the distance travelled after the initiation of deceleration through the counting of distance pulses from the tachometer generator 8, and this it is possible to provide a speed instruction for decreasing speed with the distance covered.

As a third use, the measurement of the distance travelled by the car will be described. In the latch 52, the maximum count of the counter 51, for instance hexadecimal FFFF when the counter 51 is a 16-bit counter, is latched, and the selection switch is set to the side of the terminal 60 for directing the distance pulses to the counter 51. At this time, it is set that no interruption will be produced even when the afore-mentioned condition for producing an interrupt signal is met by the counter 51. Also, if the content of the counter 51 is decremented by one from zero, a value FFFF is provided from the latch, so that a number equivalent to one less than hexadecimal 10000 is obtained. In this case, the count value of the counter 51 may be increased to values in excess of 16 bits through the counter may be a 16-bit counter. Thus, the count of the counter 51 indicates the number of distance pulses, i.e., the distance travelled by the car. The content of the counter 51, like the memory content, may be fetched into the MPU 20 at any time (synchronized to the clock of the microcomputer 14).

Figure 3:
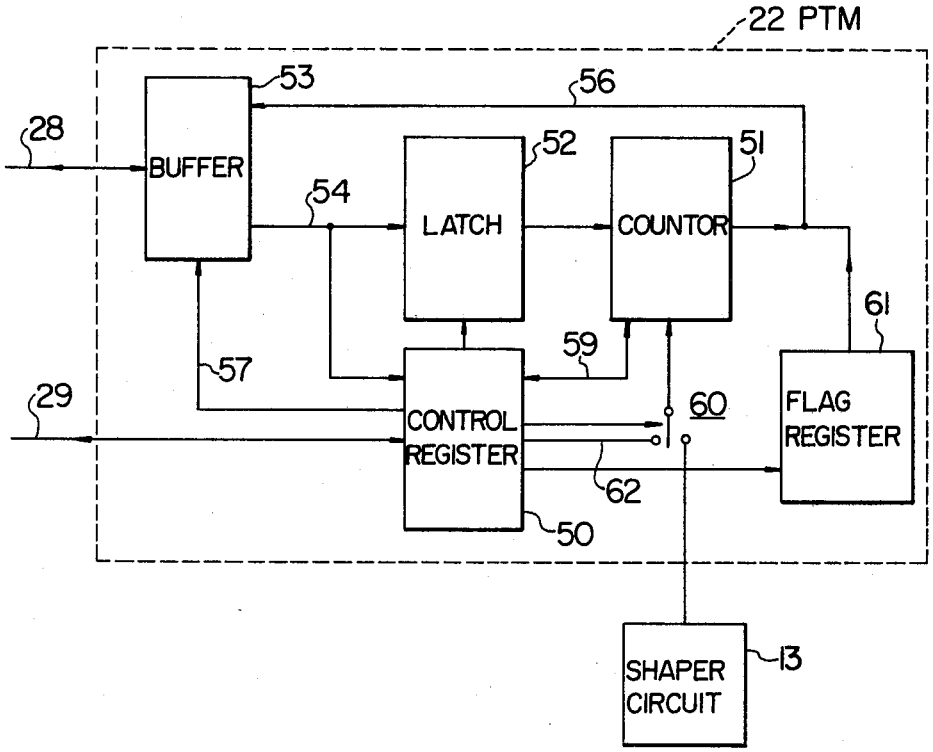

For this reason, it is assumed that the PTM 22 in the instant embodiment includes three timer counters of the construction shown in FIG. 3. These timer counters are denoted by PTM-A, PTM-B and PTM-C respectively. The PTM-A utilizes the internal clock and is provided for the first use of the PTM 22, i.e., the generation of the speed instruction at the time of the acceleration. The PTM-B is provided for the second use, receiving the distance pulses from the tachometer generator 8. The PTM-C receives the distance pulses, like the PTM-A, and is available for the third use, i.e., the measurement of the distance travelled by the car.

While the PTM 22 finds the first to third uses mentioned, the invention is adapted for the third use (PTM-C), i.e., the measurement of the floor height.

Figure 4:
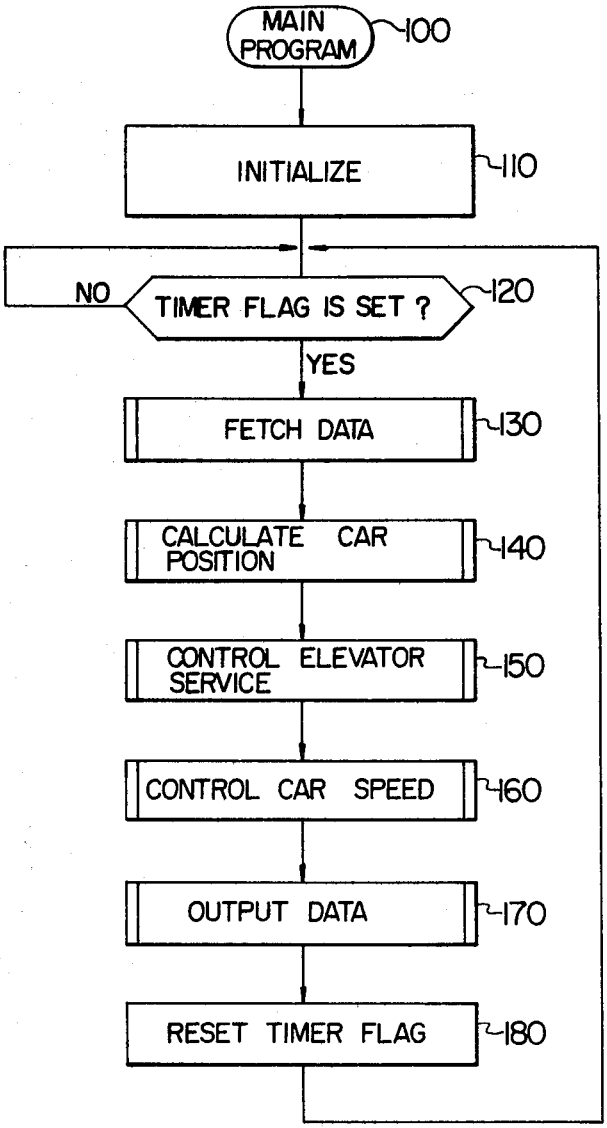

Now, the elevator control by the microcomputor 14 will be summarized with reference to the flow diagram of a main program shown in FIG. 4. This main program is permanently fixed in the ROM 26 so that it will not be lost due to noise or power loss.

The first step in the main program 100 is an initialization step 110, in which the initialization of the PTM 22, PIAs 23, 24 and 25 and timer 21 and also the setting and resetting of flags necessary for the elevator service and setting of data are effected. Then, a step 120 is executed so that various elevator system jobs may be sequentially done in a cycle period T. The timer flag at this time is set in an interrupt process for every period T, and if the timer flag is set, the following steps, namely a step 130 in which signals from various switches and sensors in the elevator system are fetched in and the setting and resetting of flags with respect to these input signals are effected, a step 140 in which the car position is calculated from the content of the PTM 22, a step 150 in which the elevator service is controlled on the basis of the state of various inputs and the results of various calculations, a step 160 in which the car speed is controlled so that the passengers may feel confort, a step 170 in which the data obtained in the steps 140, 150 and 160 are output to the elevator control circuit 19 and phase shifter 18, and a step 180 in which the timer flag is reset for causing again the execution of the step 120, are executed in the mentioned order.

The total processing period required for the steps 130 through 180 is made shorter than the period T except for the case when the microcomputer 14 is in trouble.

Normally, the elevator service is controlled by the microcomputer 14 in accordance with the main program 100 and subprograms of the steps 110 to 180.

Of the main program 100, the invention appertains to the step 140 of the car position calculation, in which a processing to be described hereinunder is carried out. The other steps 110 to 130 and 150 to 180 may respectively be of the conventional contents and are irrelevant to the invention, so their detailed description is not given.

FIG. 5 shows a memory map of data used in accordance with the invention. This memory map is stored in the RAM 27 shown in FIG. 2, and various data stored in addresses $A_1$ to $A_8$, $A_{21}$ to $A_{24}$ and $F_0$ to $F_{n+1}$ may be freely renewed. The greatest feature of this memory map resides in that the floor height data for the individual floors can be stored in the RAM 27.

Figure 6:
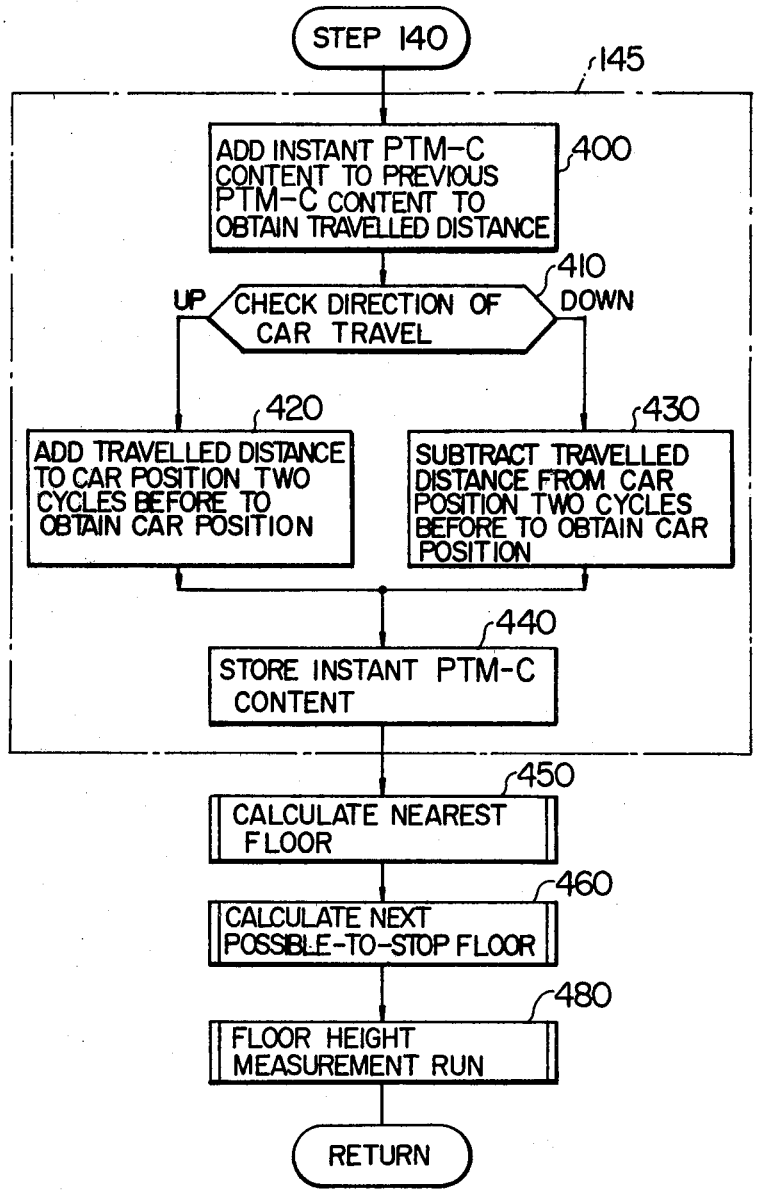

FIG. 6 shows a program flow diagram of the car position calculation step 140 (FIG. 4). As has been mentioned previously, this step 140 is executed for every period T, and the count of the afore-mentioned PTM-C is utilized for the calculation of the car position.

In a first step 400 of this subprogram, the distance travelled by the car for the period T up to the instant moment is calculated by subtracting the instant PTM-C content from the PTM-C content the period T ago. Then, in a step 410 whether the car is moving in the up or down direction is determined from the car moving direction data which has been fetched out and stored in the address $A_4$ in FIG. 5 in the step 130. If the car is moving upwardly, a step 240 is executed, in which the instant car position is calculated by adding the travelled distance obtained in the step 400 to the car position at the time the period T ago, which is stored in the address $A_3$ in FIG. 5, and the calculated car position is stored in the address $A_3$ in FIG. 5. If the car is moving downwardly, a step 430 is executed, in which the result of subtraction of the afore-mentioned travelled distance from the car position at the time the period T ago in the address $A_3$ in FIG. 5. In a subsequent step 440, the instant PTM-C content is read out and stored in the address $A_2$ in FIG. 5. Thus, the previous PTM-C count is always stored in the address $A_2$ in FIG. 5, and the previous car position is always stored in the address $A_3$ in FIG. 5.

If in the step 400 the previous PTM-C content is smaller than the instant one, the microcomputor 14 sets a borrow flag, but this can be thought without any trouble to be a change of the highermost bit of the next higher place counter from one to zero.

The car position stored in the address $A_3$ in the above way is utilized when executing the following steps 450 and 460 in the normal elevator operation.

In the step 450, a nearest floor data is derived from the afore-mentioned car position. The car position mentioned above is obtained through the counting of distance pulses and therefore indicates the distance of the car from a particular reference point. In the step 450, the nearest floor to the car position is determined by using floor height data which are obtained by measurement to be described hereinunder and stored in the addresses $F_0$ to $F_m$. For example, when the car position data stored in the address $A_3$ is a count corresponding to 20 (m), it is nearest to a floor height data of 19.2 (m) stored in the address $F_3$. In this case, the nearest floor signal represents the third floor, and this floor data is stored in the address $A_5$. This nearest floor signal is used for the car position display.

In the step 460, the floor at which the car under acceleration or deceleration can be landed (i.e., the next possible-to-stop floor) is determined. The next possible-to-stop floor is leading the car position at least by the distance required for the car to be decelerated to a stop. For example, when the car is at a position of the afore-mentioned count of 20 (m) and has to cover a distance of 6 (m) for being decelerated to a stop, the next possible-to-stop floor data represents the fourth floor from reference to FIG. 5. If there is a corridor call or a car call for service at the floor represented by the next possible-to-stop floor, this floor is the next stop floor.

The next possible-to-stop floor data and next stop floor data obtained in the above way are stored in the respective addresses $A_6$ and $A_7$. In the normal elevator operation, the steps 450 and 460 are irrelevant to the invention and may be conventionally realized, so their detailed description is not given.

A subsequent step 480, which is a floor height measurement run step, is a feature of the invention, with its detailed program flow diagram being shown in FIG. 8. When this step 480 is executed, the car position calculation step 140 is ended.

Before describing the floor height measurement run step 480 shown in FIG. 8, the operational principles underlying this step will first be described with reference to FIGS. *7a* to *7d*. These FIGS. *7a* to *7d* are enlarged-scale pictorial views showing the neighborhood of the car 1 inclusive thereof in four different positions of the car particularly for illustrating the relation between the floor position detectors 10 and 11 and shield plates 9A to 9N provided on the side of the hatchway.

In the instant embodiment, when the floor position detector 10 or 11 is facing one of the shield plates 9A to 9N, it is said to be in an "operative state". Otherwise, it is said to be in an "inoperative state". Also, the switching of the detector 10 or 11 from the inoperative state to the operative state is referred to as an "on action", and the converse switching is referred to as an "off action". Further, the reference position is set at a point 10 meters below the landing level of the lowest floor (here the first floor), although it may be set at the landing level of the lowest floor. Thus, the floor height of the first floor here is 10 meters.

FIG. *7a* shows the car 1 positioned a distance $L_1$ below the landing level of the first floor. The floor height measurement run is started form this position.

With the car 1 in the position shown in FIG. *7a*, the extremely floor deceleration switch 121 for the downward travel is already operative. With this switch 121 in the operative state and with the floor position detector 10 operative and the detector 11 inoperative, it is automatically decided that the car 1 is positioned below the first floor, i.e., at its position ready to start the floor height measurement run.

FIG. *7a* shows the case of measurement by first lowering the car to the position the distance $L_1$ below the landing level in order to increase the accuracy of the measurement and minimize fluctuations of the measurement result.

If it is determined that the floor height mearuement run is necessary, the car is preliminarly run to hold it in the position shown in FIG. *7a*.

Then, the car is run upwards at a low speed to be described later for the floor height measurement.

FIG. *7b* shows the car 1 in its state moving upwards and just leaving a door open zone. This position is detected as the floor position detector 10 leaves the shield plate 9A for the first floor. At this time, the car 1 is at its position a distance $L_2$ above the landing level of the first floor, so that a value corresponding to $10+L_2$ (m) is set as the car position data in the address $A_3$ shown in FIG. 5.

At this time, the car 1 has already covered a distance $L_1+L_2$. Thus, if it is the case that the measurement run is caused at a low speed, the car has already undergone acceleration and moving at a constant speed, so that the measurement can be obtained under a universal condition.

To obtain the subsequent elevator car position, the distance pulses provided from the tachometer generator 8 are counted up for every period T as explained earlier in connection with the step 145.

The positions of the car 1 shown in FIGS. *7a* and *7b* are detected for starting the floor height measurement in order to help avoid errors because it is likely that no distance pulse is provided to the microcomputer 14 in the initial stage of acceleration, during which period the tachometer generator 8 provides little output.

The second reason for doing this is to reduce fluctuations of the initial stage by keeping a constant relation between the operative period of the shaper circuit 12 which generates the distance pulses and processing period of the microcomputor.

FIG. *7c* shows the car 1 approaching a B floor with the floor position detector 10 being immediately before being switched to the operative state.

FIG. *7d* shows the car 1 passing by the floor height detection position for the B floor. At this time, the floor position detector 10 is already operative, and the other detector 11 is at its position to provide the "on action". With the "on action" signal of the floor position detector 11 provided in this state, the mirocomputor 14 executes the following.

(1) Adds a numerical value corresponding to the distance $L_4$ to the numerical value of the car position data in the address $A_3$, and stores the result in the floor height data area for the B floor in the corresponding one of the addresses $F_2$ to $F_4$. For example, if the B floor is the second floor, the result is stored in the data area in the address $F_2$.

The floor No. of the floor for which the measurement is made is set in a measured floor No. data area in the address $A_{22}$, and by renewing this data the data area in which to store the floor height data is specified.

(2) If the extremely floor deceleration switch 122 is operative in the car position shown in FIG. *7d*, the microcomputer 14 decides that floor to be the uppermost floor and decelerates the car 1 to a stop.

(3) If the floor is decided to be the uppermost floor, the microcomputor 14 processes the floor height values in the addresses $F_0$ to $F_n$ in FIG. 5 according to a predetermined formula, and stores the resultant value or code in the address $F_{n+1}$.

Examples of the simple code to meet this are (a) a cumulative floor height code, and (b) a sum code which is indicative of the sum of the individual floor height values temselves.

When the car 1 reaches the uppermost floor to complete the measurement of the floor heights and preparation of the sum code, the floor height measurement run is ended.

Now, the program for the floor height measurement mentioned above will be described in detail with reference to FIGS. 8 to 11.

FIG. 8 is the detailed program flow diagram of the floor height measurement run step 480 shown in FIG. 6 as mentioned earlier.

Referring to the Figure, in a step 482 whether or not a floor height measurement run request signal is provided is checked with reference to the data in the address $A_{23}$ in FIG. 5. If no floor height measurement run request is set in the address $A_{23}$, a step 495 is executed, which is a sum code check step, that is, in which whether the floor height data stored in the addresses $F_0$ to $F_n$ are not destructed by noise or power loss is checked. The details of this step 495 is shown in the flow diagram of FIG. 10. Referring to FIG. 10, in a step 4951 the sum of the floor height values of the first to n-th floors is obtained, in a step 4952 the sum and 2.5 (m)×n (n being the number of floors) are compared if the sum is greater than 2.5×n, and in a step 4953 the sum and the sum code stored in the address $F_{n+1}$ are compared if they are equal to. The 2.5 (m)×n in the step 4925 has the meaning that the distance between the floors is usually greater than 2.5 (m) so that the product of this value and the number n of floors represents the lower limit of the minimum floor height value. Thus, if the sum mentioned above is smaller than 2.5 (m)×n, the floor height value stored is erroneous, so that a step 497 (FIG. 8) is executed. Also, if no coincidence is obtained in the step 4953, the stored data is erroneous, so that the step 497 is executed. If the floor height data is found to contain no error as a result of the sum code check, a step 496 is executed.

In the step 496, whether there is an external floor height measurement run request is checked. For example, at the time of the installation or maintenance of the elevator system, a floor height measurement run request instruction may be given to the microcomputor 14 from a push button switch provided on the monitor panel 33 in FIG. 2 or the like. In the step 496, whether there is such a request is checked.

If the floor height data is correct and there is no external request, the step 480 is ended. If there is an error and/or a request, a floor height measurement run request is set in the address $A_{23}$ in the step 497, thus bringing an end to the step 480.

When the floor height measurement run request is set in the address $A_{23}$, in the step 480 in the next cycle, the step 482 yields the request signal presence, and a step 483 is executed. Since at this time no floor height measurement run state signal is set in the address $A_{21}$, a subsequent step 484 is executed, in which whether the car 1 is in its position shown in FIG. *7a* is checked. Namely, if the deceleration switch 121 and floor position detector 10 are operative, while the detector 11 is inoperative, it is determined that the car 1 is at its position ready to start the floor height measurement run, as shown in FIG. *7a*, and a step 485 is executed, in which the floor height measurement run state signal is set in the address $A_{21}$. If the car 1 is not in its position of FIG. *7a*, a step 487 is executed, in which a low speed downward elevator run instruction is generated. With the generation of the downward run instruction, the car 1 is set to downward motion at a low speed by the action of the phase shifter 15 and elevator control circuit 19 as is well known in the art. This state is continued until the condition in the step 484 is established.

When the floor height measurement run state data is set in the address $A_{21}$, in the next following cycles a step 488 is executed, in which whether the upward travel extremely floor deceleration switch 122 and floor position detectors 10 and 11 are all operative, that is, whether the position shown in FIG. *7d* is reached, is checked. This condition is not met at this time since the car 1 is in its position shown in FIG. *7a*, so that a step 493 is executed.

This step 493 is opposite to the step 487, that is, in which an upward constant speed elevator run instruction is generated. Thus, the upward run of the car 1 is started from its position of FIG. *7a* for the floor height measurement. This step 493 is in force to continue the upward low speed run of the car 1 until the condition in the afore-mentioned step 488 is met. During this low speed upward run for the floor height measurement, the measurement of floor height which will be described hereinunder with reference to FIG. 9 is effected every time the car 1 comes to assume the position of FIG. *7d*. Thus, by the time when the condition in the step 488 in FIG. 8 is met, the floor height data for the first to n-th floors are all stored in the data areas of the addresses $F_0$ to $F_n$.

When the condition in the step 488 is met, a step 490 is subsequently executed, in which the sum code of the floor height data is prepared. The details of the step 490 is shown in FIG. 11. Referring to FIG. 9, in a step 491A the leading address $F_0$ in which the floor height value is stored is set in the sum check address $A_{24}$, and in a step 491B a register used for the calculation of the sum (i.e., an accumulator in the MPU 20) is cleared. Subsequently, in steps 491C to 491E the floor height value indicated by the sum check address is added to the sum calculation register content to renew the sum address, and in this way the floor height values in all the addresses $F_0$ to $F_n$ are added together in the sum calculation register. In a step 491E the content of the sum calculation register obtained in the above way is stored as the sum code in the address $F_{n+1}$. Thus, the floor height sum (101.1 m) of the values of the individual floors in the addresses $F_0$ to $F_n$ (while the values are shown in m as the unit, actually the pulse numbers corresponding to these distances) are stored as the sum code.

When the step 490 is ended, steps 491 and 492 are executed to clear the floor height measurement run request signal and floor height measurement run state signal to bring an end to the floor height measurement run.

Thus, in the next and following cycles, the steps 495 and 496 are executed. In other words, normally whether there is no error in the stored floor height data and floor height measurement run request is checked.

Now, the floor height measurement step 340 shown in FIG. 9 will be described in detail. This step 340, unlike the previous step 480, is not executed during each timer period T but is brought about as an interrupt process. More particularly, it is caused as an interrupt process in accordance with the action of the floor position detectors 10 and 11 while the step 493 of the upward run for the floor height measurement is in force.

Referring to FIG. 9, in a step 341 the action of the floor position detector 10 is checked. The details of this step 341 is shown in FIG. 12. In a step 341A whether there is an action signal from the floor position detector 10, i.e., an interrupt request signal IRQ therefrom is applied to the PIA 23, is checked. Then, in a step 341B whether the action mode is the fall mode (i.e., "off action") is checked. If it is not the fall mode, whether it is the rise mode (i.e., "on action") is checked. In this way, the "on action", "off action" and "non-action" of the detector 10 is checked.

In a step 3400, the action of the floor position detector 11 is checked in the same way as in FIG. 12.

As described earlier in connection with FIGS. *7a* to *7d* and 8, the floor height measurement run starts from the state shown in FIG. *7a*. Thus, the "on action" signal from the floor position detector 11 is coupled. At this time, it is determined in a step 341 (FIG. 9) that the detector 10 is inoperative, and in a step 3400 the "on action" of the detector 11 is checked to execute a step 3406, in which whether the floor height measurement floor data is set in the address $A_{22}$ is checked. Since at this time it is not set yet, its absence is determined to bring an end to the interrupt process of the step 340. That is, the first "on action" of the detector 11 is made ineffective in a step 3406.

Figure 7A:
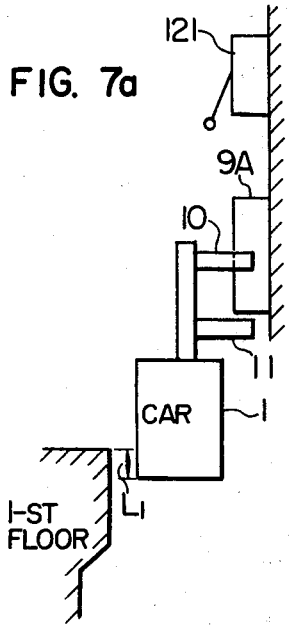
Figure 7B:
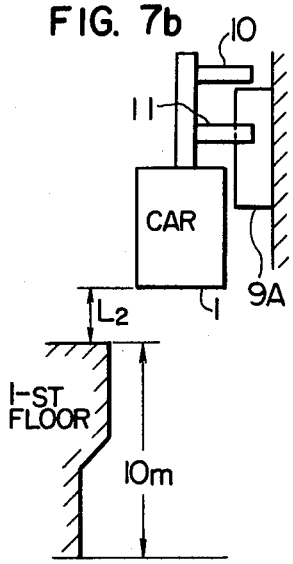
Figure 7C:
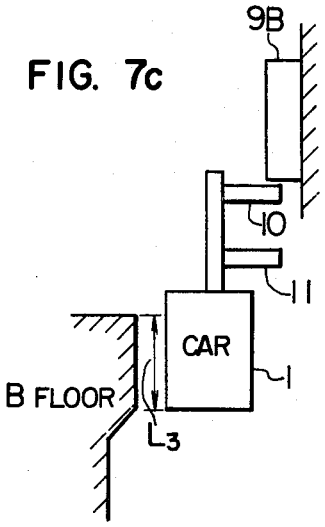

When the car is run upwards and comes to assume its position shown in FIG. 7*b*, the detector 10 leaves the shield plate 9A, so that the action signal from the detector 10 rises. Thus, in the step 341 the "off action" is determined to execute the step 342. In this step 342, like the step 3406, the absence of the floor height measurement floor data is detected to execute a step 343, in which the value 10 (m)+$L_2$ is stored in the car position data area in the address $A_3$. This means that the car position shown in FIG. 7*b* can be obtained from the value 10 (m)+$L_2$. The initialization of the car position data is effected by storing this value in the car position data area. Further, since the value 10 (m) is predetermined, there is no need of measuring the floor height of the first foor, and a numerical value corresponding to 10 (m) may be stored in the address $F_1$.

After the car position data in the address $A_3$ is set to that shown in FIG. 7*b* in the above way, a step 345 is executed, in which the floor height measurement floor is preset in the address $A_{22}$. In the instant embodiment, the floor which is subjected to the measurement for the first time is the second floor, so that the presetting in the address $F_2$ in which the floor height value of the second floor is stored is made.

In a step 346, the step 440 (FIG. 6) is executed, in which the content of the PTM-C is stored in the address $A_2$.

When the steps 343 to 346 are once executed, even the subsequent "off action" of the floor position detector 10 does not cause repeated execution of the steps since the presence of floor data is determined in the step 342.

Figure 7D:
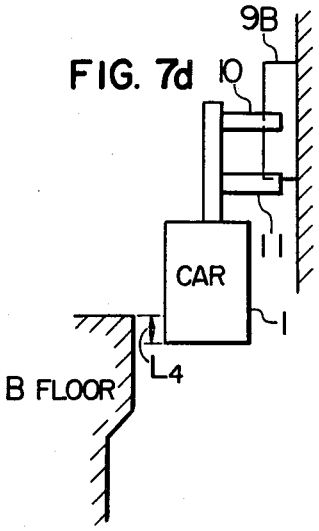

Subsequently, every time the car 1 is moved upwards to the position shown in FIG. 7*d*, the steps 3406 through 3412 are caused by the "on action" of the floor position detector 11.

More particularly, when the "on action" of the floor position detector 11 is caused with the approach of the car 1 to the second floor, the presence of the floor data is determined in the step 3406 to cause execution of a step 3408, in which the step 145 in FIG. 6 is executed. Thus, the car position at this time is stored in the address $A_3$ by the method described above, and the PTM-C content at this time is stored in the address $A_2$.

In a step 3410, the sum of the car position stored in the address $A_3$ and distance $L_4$ is stored indicated by the floor height measurement floor (address $A_{22}$). At this moment, the floor height measurement floor is the second floor and $F_2$ is set in the address $A_{22}$, so that the afore-mentioned sum is stored in the data area of the address $F_2$. The distance $L_4$ is added in the above processing for the purpose of correcting an error amounting to the distance $L_4$ that is present between the car position to cause the "on action" of the detector 11 and the landing level. This correction is not needed where the position to cause the "on action" of the detector 11 and the landing level coincide. In this case, the car position at that time can be directly stored as the floor height value.

In a step 3412, the floor height measurement floor data is renewed, in the instant case the next floor is the third floor, so that $F_3$ is stored in the address $A_{22}$.

Thus, every time the "on action" of the detector 11 is caused with the upward run of the car 1, the floor height value of each floor is automatically measured, and the measured values are stored in the successive addresses $F_3$ to $F_n$.

As has been described in the foregoing, with the instant embodiment of the invention it is possible to measure the floor height values of the individual floors very quickly and easily and store the measured data in the RAM 27. Thus, there is no need of constructing the RAM 26 such that it is adapted to the building for each elevator. Besides, since the elevator car is run at a constant low speed for the floor height measurement, it is possible to minimize the measuring error due to delays involved in the detection level of the alternating current tachometer generator 8 and the operation of the shaper circuit 13 and also the processing time required for the microcomputor 14. Further, since the processing of the floor height measurement for the individual floors is all timed to the instant of the "on action" of the floor position detector 11, it is possible to minimize the fluctuations of the processing timing and also freely select the length of the shield plates 9A to 9N according to use.

Still further, since the error in the floor height data stored is checked for in the step 495 (FIG. 8), high reliability can be ensured, and even in the event of the occurrence of an error, the floor height measurement is automatically effected without the necessity of interrupting the elevator service.

Furthermore, the elevator drive system is worn in long use. With this wear, for instance with the wear of the traction sheave 4 and the rope 3 shown in FIG. 1, the distance covered per distance pulse is changed. Therefore, even without the change of the height of the building structure, the relation between the distance pulses and the count is prone to changes, and the landing precision is deteriorated as the aforementioned wear proceeds. According to the invention, even in such a case there is no need of replacing the ROM 26, but by merely instructing the floor height measurement run from the supervision panel 33, floor height data compensated for the wear are automatically stored in the RAM 27. This also applies to the case when it is necessary to replace component parts due to the rupture of the ROM 26. Even in this respect, there is no need of constructing the ROM 26 such as to adapt it to the building structure, so that the maintenance of the elevator system can be extremely simplified.

In the meantime, while in the above embodiment the floor height data are stored in the RAM 27, they may be stored in any other memory means as well so long as the memory means are renewable data memory. For example, the EPROM (Electrically Programmable Read-Only Memory) is capable of electrically erasing and rewriting data as is well known in the art, so it can be used when desired.

Moreover, it is possible to bring about the floor height measurement step 340 (FIG. 9) not as an interrupt process. For example, it may be arranged such that this step may be executed after the step 480 (FIG. 8) or in a yet earlier stage of the timer period.

What we claim is:

1. An elevator control system comprising:

an elevator car moving in a hatchway in a building structure with a plurality of floors;

means for providing distance pulses in proportion to the distance travelled by the car;

means for detecting the landing of the car at each floor;

means for memorizing floor height data indicative of the distance of the landing position at each floor from a reference point in the hatchway, said memorizing means being capable of renewing memorized data;

means for counting said distance pulses;

means for controlling the elevator traffic at least according to a car position obtained from said counting means and the memorized floor height data stored in said memorizing means;

means for generating a floor height measurement run request signal;

means for setting said counting means under the control of said floor height measurement drive request signal to drive the car in the up or down direction from a predetermined position relative to the hatchway; and means for loading the count of said counting means into said renewable data memory means under the control of said landing detecting means.

2. The elevator control system of claim 9, wherein said loading means loads a corrected count value, obtained through the correction of the count of said counting means with a predetermined value, into said memory means.

3. The elevator control system of claim 10, wherein said predetermined value is set to a numerical value corresponding to the difference between the car position at which said landing detection means is operated and the relevant landing position.

4. The elevator control system of claim 9, wherein said driving means includes means for driving the car to said predetermined position according to said floor height measurement drive request signal.

5. The elevator control system of claim 9, wherein said floor height measurement drive request signal generating means includes means for detecting an error of floor height data loaded in said renewable data memory means, said floor height measurement drive request signal being generated when said error detecting means detects an error in the loaded floor height data.

6. The elevator control system of claim 13, wherein said floor height data error detection means detects an error in said located floor height data through the comparison of the sum of the loaded floor height values for the individual floors and a preset value.

7. The elevator control system of claim 13, wherein said floor height data error detection means includes means for deriving a sum code from the loaded floor height values for the individual floors and memorizing said sum code, said memorized sum code being compared with a subsequently derived sum code for the floor height data error detection.

8. The elevator control system of claim 9, wherein said driving means effects low speed drive according to said floor height measurement drive request signal.

9. The elevator control system of claim 9, wherein said landing detection means includes detectable members each provided in the hatchway in the neighborhood of each floor and a detecting member provided on the car and actuated when in a position facing each said detectable member.

* * * * *